US006336350B1

(12) United States Patent
Klein

(10) Patent No.: US 6,336,350 B1
(45) Date of Patent: Jan. 8, 2002

(54) METHOD FOR THE FLEXIBLE ROLLING OF A METALLIC STRIP

(75) Inventor: Friedrich Klein, Attendorn (DE)

(73) Assignee: Muhr und Bender KG, Attendorn (DE)

( * ) Notice: Subject to any disclaimer, the term of this patent is extended or adjusted under 35 U.S.C. 154(b) by 0 days.

(21) Appl. No.: 09/634,718

(22) Filed: Aug. 7, 2000

(30) Foreign Application Priority Data

| | | |
|---|---|---|
| Aug. 6, 1999 | (DE) | 199 36 522 |
| Oct. 28, 1999 | (DE) | 199 51 889 |
| Nov. 11, 1999 | (DE) | 199 54 425 |
| Dec. 23, 1999 | (DE) | 199 62 754 |

(51) Int. Cl.[7] ..... B21B 31/07

(52) U.S. Cl. ..... 72/240; 72/8.5; 72/11.3; 72/365.2

(58) Field of Search ..... 72/8.5, 9.1, 9.2, 72/9.4, 11.3, 11.7, 11.8, 12.2, 12.7, 12.8, 240, 365.2, 366.2

(56) References Cited

U.S. PATENT DOCUMENTS

| | | | | |
|---|---|---|---|---|
| 3,913,363 A | * | 10/1975 | Fujui et al. | 72/10 |
| 4,506,532 A | * | 3/1985 | Anbe | 72/234 |
| 4,936,132 A | * | 6/1990 | Kato et al. | 72/240 |
| 5,651,281 A | | 7/1997 | Seidel | |
| 5,871,138 A | * | 2/1999 | Shishido et al. | 228/102 |

FOREIGN PATENT DOCUMENTS

| | | | | |
|---|---|---|---|---|
| DE | 22 64 333 | | 7/1974 | |
| DE | 43 09 986 A1 | | 10/1994 | |
| JP | 6-154806 | * | 6/1994 | 72/240 |
| JP | 9-122727 | | 5/1997 | |

* cited by examiner

*Primary Examiner*—Ed Tolan
(74) *Attorney, Agent, or Firm*—Nixon Peabody LLP; David S. Safran

(57) ABSTRACT

A method for the flexible rolling of a metallic band wherein, during the rolling procedure, the metallic strip is lead through a roll gap which is formed between two working rolls and which is set so that, over the length of the metallic strip, strip sections are obtained with different strip thickness. In order to prevent temperature-related deviations in the thickness and length profiles of the metallic strip, a compensation of the temperature influence effecting the metallic strip is carried out during rolling in order to prevent deviations from the theoretical thickness and/or the theoretical length of the individual strip sections at a default temperature of the metallic strip.

30 Claims, 2 Drawing Sheets

METHOD FOR THE FLEXIBLE ROLLING OF A METALLIC STRIP

BACKGROUND OF THE INVENTION

1. Field of the Invention

The invention relates to a method for the flexible rolling of a metallic strip wherein, during the rolling procedure, the metallic strip is lead through a roll gap which is formed between two working rolls that are set so that strip sections are obtained with different strip thicknesses over the length of the metallic strip.

2. Description of Related Art

Flexible rolling as a method for the production of planar metallic strips with different, default strip thicknesses over their length is known in practice and is characterized in that the roll gap is diliberately altered during the rolling operation in order to obtain different band thicknesses over the length of the metallic strip. This can occur, on the one hand, directly by altering the tensile strength of the material via a heating or cooling of the metallic strip and a correspondingly altered swelling of the rolling stand during the rolling procedure. In this case, the temperature of the rolled stock can be not only above, but also below the recrystalization temperature. On the other hand, the alteration of the roll gap can be carried out with a direct method of the roll gap via the working rolls. Subsequently, both possibilities for obtaining a definite strip thickness pattern are understood by flexible rolling.

In flexible rolling—as explained above—strip sections are rolled with different strip thicknesses which can be connected to one another with different inclinations, from which multiple possibilities for a thickness profile result. The object of flexible rolling is to produce rolled stock with a load- and weight-optimized cross section. Flexible rolling allows the procedure-shortening manufacture of plates and sheets with a definite, component-individual thickness profile adapted to the load instance in the longitudinal direction of rolling. Such manufactured plates are not only suitable for automobile construction, but also for aeronautical and aerospace engineering and the construction of railroad cars. They can be re-shaped by corresponding processing steps, like, for example, internal pressure re-shaping or deep drawing. A profile manufacture with only one step substantially contributes to the high economic potential of this production technology. The thechnological advantages come especially from the continuity of the characteristics of the materials of the rolled stock, the applicability on all rollable materials as well as the flexibility of the manufacturing method.

The method is designed, as is common, as strip rolling from coil to coil, but variations such as coil to plate or plate to plate are also known. In coil to coil rolling, the winch-applied strip tension supports the rolling procedure and substantially improves the uniformity of the strip section in the longitudinal direction, i.e. in the rolling direction. By the way, flexible rolling from coil to coil guarantees a high productivity at the same time since the thickness profile is continuously generated in the strip.

It is of crucial importance in flexible rolling and also in the conventional rolling procedure to manufacture a planar metallic strip with a default thickness measure. In order to fulfil this specification, it is continuously tried, in rolling, to guarantee a uniform gap measure of the roll gap in rolling. This is not without problems since rolling requires substantial energy for the deformation of the roll stock found in the intake zone leading to the roll gap—which leads to a an elastic deflection of the roll. A deflection curve bending line which is almost parabolic and which corresponds to the axle center of the roll results through the deflection of the roll which is supported on both ends. Since the deflection causes a deviation from the uniform gap measure or the ideal gap, corrective measures are necessary.

One measure for correcting the deviation from the ideal gap—caused by the deflection of the rolls—consists of bowing the barrel-shaped or bellied construction of the roll body. With this type of correction, it is possible to bow only the working rolls, only the back-up rolls or both the working rolls and the back-up rolls. The bowing should compensate the deflection, which is caused by the roll force and the weight of the rolls, so that the gap between the rolls runs uniformly again, i.e., the length over the rolls is constant. Generally, the correction of the deflection curve bending line, however, is not complete and applies only to definite operational instance since the shape of the roll or the bowing is not changeable.

A further possibility for correction is seen in that, in each case, a roll body is placed oblique to its axis by a horizontal turning from the center of its line of contact with the corresponding roll. This oblique placement alters the gaps at he ends of the rolls while the center remains unchanged. Through its variation possibilities, the oblique placement of the rolls allows particularly for an approximated compensation of the defection for almost all operational instances, but is comparable to the exactness obtainable with the already-mentioned parabolic surface of the roll body.

Furthermore, it is possible to create a moment of deflection through the application of forces on the bearing necks of the rolls which works against the moment of deflection in rolling. This biasing of the rolls also allows, like the oblique placement, an approximated compensation for almost all operational instances. The substantially increased stress on the bearing is, however, disadvantageous. In respect to the obtainable compensation, biasing can be compared with the parabolic surface.

Finally, a further possibility for correction exists in working roll cooling, which deals with thermal bowing.

It is understood that the already-mentioned correction possibilities for obtaining an ideal roll gap in rolling mills can be used alone or in combination with one another.

Lastly, all the aforementioned measures serve the purpose of obtaining a planar metallic strip with a default thickness measure. To achieve this with flexible rolling is especially problematic since during the rolling procedure, large load fluctuations on the roll stand—which for one thing, no doubt, achieve the desired changes in strip thickness and for another, however, involve a substantial change of the roll load over the width particularly for wider metallic strips—constantly arise due to the frequent differences in thickness of the metallic strip. Through this, the deflection curve bending line of the working roll is influenced as is, consequently, the geometric formation of the roll gap and with it the planeness, as long as no correction to the implementation of an even gap measure follows. Should, in flexible rolling, the roll gap corresponding to the required strip section be run without correction, a characteristic, non-planar strip section develops over the width for this load change. Due to this non-planeness, there is the danger of corrugation on the edges or rips in the strip since the ordered alteration in height and the ordered alteration in length corresponding to it are not constant over the width. Because of this, different thicknesses result over the width and from this, different lengths which cause these flaws in the strip.

In the conventional strip rolling procedure for the production of planar metallic strips with an even thickness over their length, both the thickness of the strip and the planeness are constantly set, monitored over complex control loops and controlled via corresponding correcting elements at occurring deviations. A control device for stabilizing the rolling-force-conditioned roll deflection in the conventional strip rolling procedure is known, for example, from German Patent DE 22 64 333 C3. Principally, such complex control loops can also be used in flexible rolling. However, it is problematic that the known regulation needs a definite response time and a certain recovery time until it responds and until the effect of an alteration in the disturbance variable coming from the effect of the regulation within the exactness of measurement is stabilized. This problem of the regulation response and the necessary recovery time plays a substantial role in flexible rolling since, in part, very short portions of strip with different thicknesses must be rolled at partially high rolling speeds and the planeness and the default strip thickness should, finally, be guaranteed over the entire length of the flexibly-rolled strip. This is particularly difficult, especially for wider metallic strips.

Extensive efforts have been made to obtain a planar metallic strip with a default thickness profile. Until now, it has not been sufficiently taken into consideration that the temperature of the rolled stock while rolling can be not only above, but also below the temperature at which the rolled stock is processed or later used. In the following, this temperature is denoted the "end temperature." Furthermore, the temperature may intensively fluctuate during the flexible rolling procedure. This is a result of, e.g., strategic temperature alterations mentioned in the introduction or of the re-shaping energy dependant on the speed and the deformation during rolling. As opposed to classic rolling having a constant thickness if possible, the temperature fluctuations and deviations during flexible rolling could lead to objectionable deviations from the theoretical thickness and theoretical length profile in the default end temperature of the rolled stock.

In the known method of flexible rolling, after-rolling straightening may be necessary in order to guarantee the necessary evenness or planeness of the metallic strip needed for processing. This correction can ensue, for example, by a bowing straightening or also a stretch-bowing straightening.

In the conventional straightening procedure using a laying mechanism in the form of a roller leveler having a plurality of straightening rolls, the entrance and exit gaps are engaged and the metallic band or straightened stock is subjected to a multiple back and forth bending process depending on the straightening rolls having a decreasing contortion between the reversed-order straightening or bending rolls. Generally, the upper straightening roll is thereby arranged so that the remaining inherent strain in the straightened stock or the stock to be straightened is minimized. In order to obtain straightened stock with a good uniformity, the first elastic-plastic bending must be larger than the largest contortion which is presented in the finished state of the straightened stock. The contortion can be continuously decreased through a further elastic-plastic back and forth bending which becomes smaller and smaller. The final elastic-plastic bending instance must be thereby designed so that the straightened stock is no longer contorted after the elastic springing back.

Errors such as middle or edge corrugation can often not be fully taken care of in conventional roll straightening using a roller leveler since here, only bending work and no re-shaping work in the longitudinal direction is done. In order to produce straightened stock, especially metallic strips, of an especially high uniform quality, stretch-bowing straightening is used. In stretch-bowing straightening, the straightening follows in such a manner that the straightened stock is subjected to a forging strain above the yield point. Stretch-bowing straightening is especially suited for the straightening of strips having minimal non-uniformity.

However, it is problematic that, in the straightening of, especially in stretch-bowing straightening of, a flexibly rolled metallic strip, a length alteration of the material can, generally, come about which has different sizes depending on the materials, state of stress and material strength.

SUMMARY OF THE INVENTION

The object of the present invention is to provide a method of the type described in the introduction for the flexible rolling of a metallic strip in which no undesired deviations in the length and/or thickness profile of the finished, rolled and, if necessary, straightened roll stock exist.

The above-mentioned object is substantially met according to the invention, with a method as described in the introduction, in that a compensation of the temperature influence on the metallic strip is carried out during rolling in order to prevent deviations from the theoretical thickness and/or theoretical length of the individual strip sections at the default end temperature of the metallic strip. Using the inventive method, the temperature influence on the rolled stock which leads to a deviation of the length and thickness of the individual strip sections is taken into consideration during rolling. The compensation ensues from the knowledge of the length and thickness alteration of the metallic strip at different temperatures, which forms the basis of compensation.

An alternative embodiment of the present invention which is preferred, but is also possible in connection with the above-described compensation of the temperature influence, is inventively provided to meet the above-described object in that a compensation of the straightening influence operative on the metallic strip is carried out during rolling in order to prevent deviations from the theoretical thickness and/or the theoretical length of the individually straightened strip sections. In other words, this means that the lengthening or stretching of the rolled stock resulting from the straightening of the metallic strip is already taken into consideration in the preceding flexible rolling so that after the straightening of the rolled stock, the default theoretical thickness and/or theoretical length of the rolled stock results. The individual strip sections are deliberately rolled thicker than the default theoretical thickness of the straightened metallic strip since after the straightening, the length of the individual strip sections increases and their thickness decreases. The invention, thus, provides a deliberate compensation or consideration of the straightening influence already during the flexible rolling process in order to prevent deviations of the straightened profile of the theoretical profile of the metallic strip. So, the profile of the metallic strip is modified during the rolling process so that the result of the following straightening processes is the desired theoretical profile. The compensation of the straightening influence in rolling result in consideration of the knowledge of the profile alteration of the rolled stock in straightening.

The compensations described above can not only be controlled on the basis of a model but also can be regulatively carried out during the compensation of the temperature influence preferred on the basis of the actual temperature of the metallic strip or another parameter representing the temperature, like, e.g., the alteration of the length of a reference section, but also a combination of both of these possibilities. The controlling interference always comes forward especially immediately in the moment when the roll gap is altered since a regulation can not immediately respond due to the necessary response and recovery times, while the regulative interference should take place immediately after the alteration of the roll gap.

An alteration of the roll gap and/or the rolling speed come preferably into question as regulated quantities in feedback controlling or regulating. By the way, compensation is carried out during flexible rolling, preferably in the manner that, after the rolling process, the theoretical geometry of the rolled metallic strip is achieved at a room temperature of about 20° C.

It is especially advantageous to combine the inventive compensation with a feedback controlling interference and a following regulating interference in order to obtain not only the desired theoretical geometry in respect to the thickness and length of the individual strip sections at the default end temperature, but at the same time also a good planeness of the metallic strip. For this purpose, it is inventively, further provided that during each setting of the roll gap or immediately thereafter, the deflection curve bending line dependent on the setting of the roll gap is regulated to obtain planeness in the metallic strip. It is thus significant that the influence of the deflection curve bending line of the working roll while setting the roll gap is not—at least not at first—achieved by feedback control, but instead from a control or an adjustment in which one variable—here, the deflection curve bending line of the working roll—is influenced by another variable—here, the roll gap in a pre-determined, fixed connection. The compensation of the deflection curve bending line alteration results due to the load reversal from a roll gap alteration through the knowledge of the dependence of the deflection curve bending line on each roll gap. If, for example, the roll gap for a particular rolled stock is adjusted from S1 to S2, this adjustment of the roll gap leads to an alteration of the deflection of the working roll. This deflection curve bending line alteration is known and forms the basis of adjustment compensation. The knowledge of the deflection curve bending line alteration can ensue from the default geometry, but can be especially empirically won, namely thereby that the corresponding measured variables are returned to during the rolling procedure. As a result, the deflection curve bending line is adjusted, depending directly on each roll gap, via application, i.e., increase or reduction of a definite counteracting bending force, in order to keep a uniform gap measurement over the length of the roll gap. Through this adjusting interference on the rolling procedure for the setting of the roll gap, the metallic strip can be strategically worked on, and particularly, before possible following adjustments are even effective in order to, finally, provide a metallic band which is planar over the entire width.

It is especially advantageous when the planeness is regulated, i.e., feedback controlled via at least one control loop after the control, an especially immediately after the setting of the roll gap. The invention provides that, firstly, i.e., with the setting of the roll gap, merely one control is carried out. External disturbance variables, with the exception of the changing roll gap can not be taken into consideration in this case. However, if the adjusting intervention is finished, the adjustment responds in order to eliminate non-planeness remaining in the strip and therewith, to obtain a planar metallic strip. Correspondingly, the temperature influence and/or the straightening influence can be changed in the compensation.

During flexible rolling, it is necessary to multiply adjust the roll gap due to the default alteration in thickness of the metallic strip. Thus, it is further provided, according to the invention, that shortly before or during the renewed setting of the roll gap, the control of planeness is interrupted and the deflection curve bending line of the working roll dependent on the new roll gap is newly controlled. Hence, there is a continuous change between controlling and feedback control of the metallic strip depending on the default alterations of thickness over its length. This principle can, correspondingly, also be implemented in the aforementioned compensation of the temperature influence and/or the straightening influence.

In a control, default counteracting bending forces on the working rolls and/or on the back-up rolls are applied depending on the different roll gaps in order to obtain a bending of the working rolls or of the back-up and working rolls. In regard to this, to feed-back control non-planeness of the metallic strip, the counteracting bending force adjusted to each load instance is applied to the working rolls and/or back-up rolls in order to obtain, in any case, a bending of the working roll and/or a bending of the back-up and working rolls. The control, or regulation, mentioned is put into practice preferably with the said bending of the working and/or back-up rolls since, here,—corresponding to the running speed of the roll gap—alterations can be quickly realized, which is especially important for flexible rolling with strip sections which are partly very short. Other possibilities are also conceivable for influencing the planeness, e.g., by the postponing of intermediary rolling with the six high mill stand, by hydraulic-supported rolling or by cross-rolling. However, the aim, in any case, is to produce a flexibly rolled strip and, at the same time, to improve or optimize the winchability of such metallic strips.

So that the adjustment responds quickly to the control in the end, which, as already described, is of considerable importance especially for flexible rolling, it is suggested that the measuring of the planeness is done optically. The optical measurement of the planeness is easily realized immediately behind the working rolls. Therewith, the planeness of the metallic strip is preferably measured over the entire width of the metallic band behind the roll gap for each increment of length.

It is especially preferred, in connection to the optical measurement, that thickness measuring laser stations are provided over the entire width of the metallic band and that the laser thickness measurement results via triangulation. The laser thickness measurement over the entire width of the metallic band allows an easy, on-line optimization of the deflection curve bending line of the working roll. The laser thickness measurement via triangulation allows the determination of the cross section also for short strip sections of around 50 mm long because of the small area of measurement and the high measurement frequency of 1 kHz.

It is understood that it is basically possible to use methods other than optical measurement for determining whether or not non-planeness remains in the strip after the control.

A stress-metering roller, for example, can also be used. By the way, it is advantageous, to not only regulate the planeness of the metallic strip, but also the strip thickness in the longitudinal direction. This can be integrated in the control loop for the bending of the working rolls.

Next, the invention is explained more precisely with a drawing representing merely one embodiment.

DETAILED DESCRIPTION OF THE INVENTION

Figure 1:
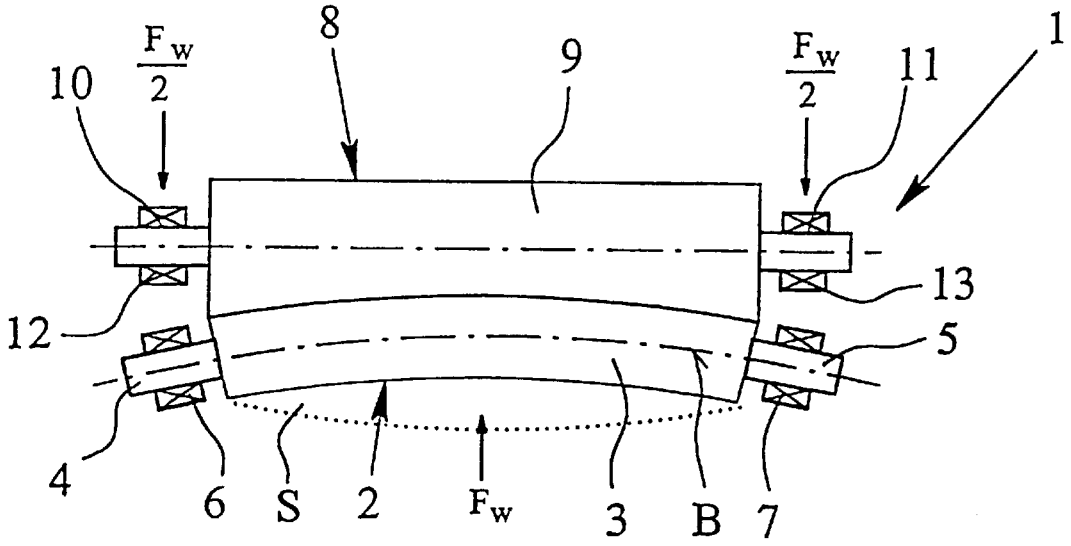
FIG. 1 is a schematic representation of a part of the rolling stand without counter-bending.
Figure 2:
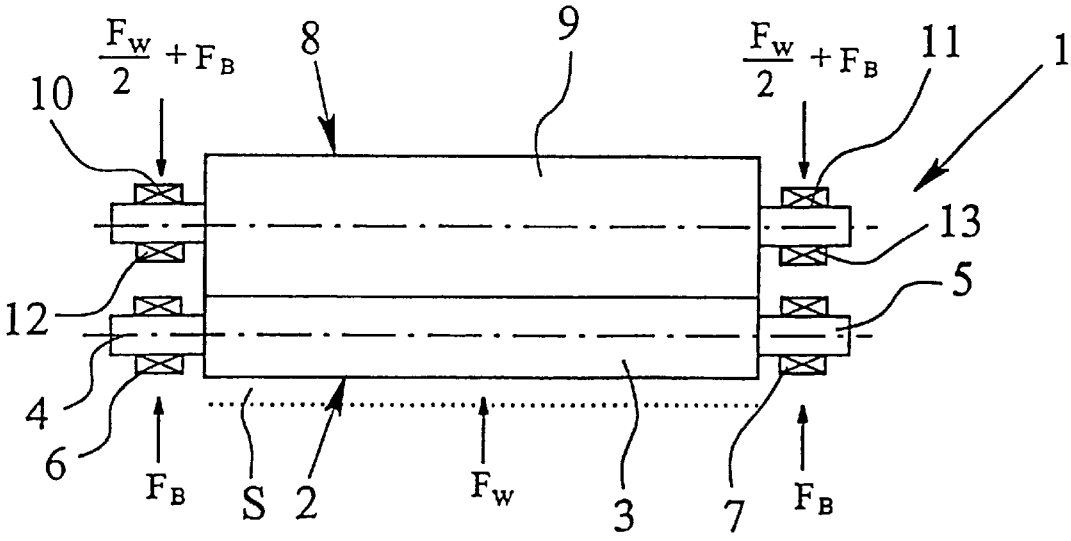
FIG. 2 is a view of the rolling stand from FIG. 1 with counter-bending.

In FIGS. 1 & 2, a part of the rolling stand 1 is represented, on the one hand, without counter-bending (FIG. 1), and on the other hand, with counter-bending (FIG. 2). A cylindrical working roll 2 with roll bodies 3 and bearing necks 4, 5 which are arranged in bearings 6, 7 are shown individually. Above the working roll 2, there is a back-up roll 8 with a cylindrical back-up roll body 9 and bearing necks 10, 11 which are arranged in bearings 12, 13. The illustrated working roll 2 and the back-up roll 8 are the two upper-most rolls of the rolling stand 1. The corresponding two lower rolls are not shown, namely a lower working roll and a lower back-up roll beyond the dotted line representation of the surface of the lower working roll which faces the upper working roll. Between the two working rolls, there is a roll gap S.

It is to be understood that the invention can be used as both by a four-high roll stand and a two-high roll stand and that, instead of cylindrical working rolls 2 and back-up rolls 8, bow-shaped rolls can also be used.

In FIG. 1, an example of an application for rolling a metallic strip, which is not shown, is represented, in which a roll force FW is exerted on the working roll 2. The roll force FW causes an elastic bending of the working roll 2 so that the deflection curve bending line B of the working roll 2 results. The roll force FW leads, however, not only to a bending of the working roll 2, but also to a bending of the back-up roll 8 which, however, is not individually shown.

In FIG. 2, the state of the rolls 2, 8 with counter-bending is shown. The roll gap S has, in contrast to the state shown in FIG. 1, a constant, uniform roll gap S, i.e., a constant distance that remains substantially the same between both areas of the working roll facing each other. In the state shown in FIG. 2, the working roll 2 is not curved. The roll separating force FW works against a counteracting bending force FB applied by the back-up roll 8.

In the illustrated embodiment, the deflection curve bending line B, which corresponds to the center axis of the working roll 2, runs parallel to the outside of the working roll 2. This is not the case with a bowed roll body 3. In this case of a roll gap which is constant over the length of the working roll, the working roll is curved—as opposed to the representation in FIG. 2—although the line or area of the working roll bordering the roll gap runs horizontally.

Flexible rolling of a metallic strip is carried out so that the roll gap S is deliberately changed during the rolling operation in order to obtain a default alteration of thickness of the metallic band over its length. Firstly, it is significant that, during the setting of the roll gap S or immediately thereafter, the deflection curve bending line B of the working roll 2, dependent on the set roll gap, is controlled for the achievement of planeness of the metallic strip. This is possible through knowledge of the dependencies of the deflection curve bending lines on the different roll gaps. Through this, the deviations due to the different roll gaps from the ideal gap are compensated.

Figure 3:
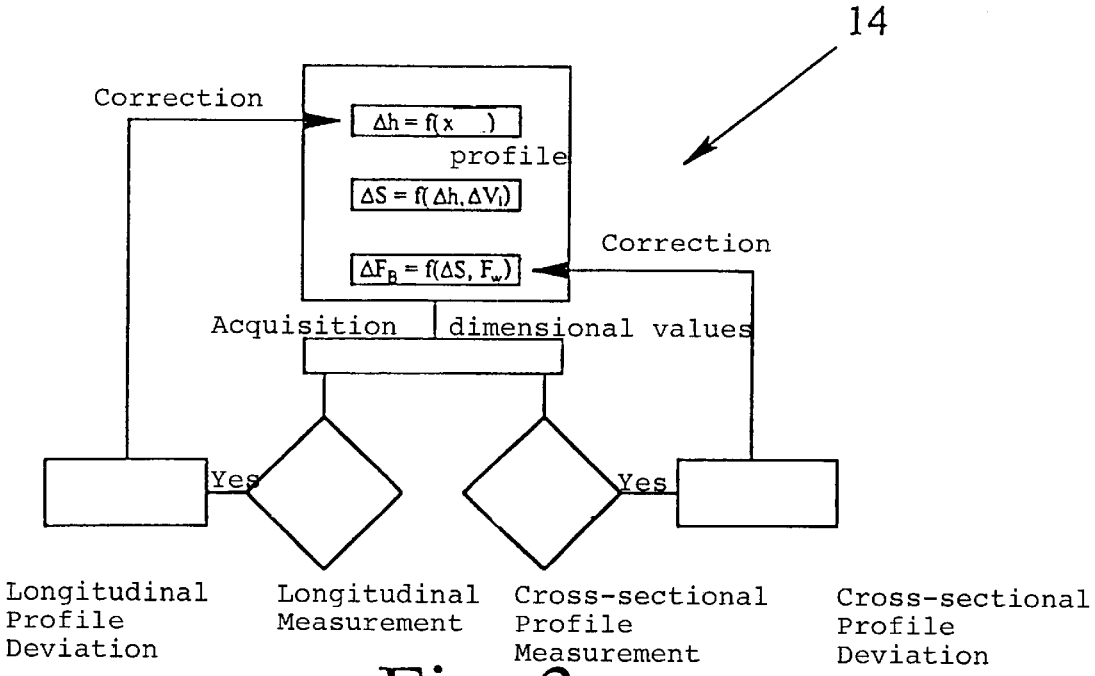
FIG. 3 is a representation of a control loop.

At the end of the controlling intervention described above with the setting of the roll gap, the planeness is regulated via the control loop shown in FIG. 3. Here, the non-planeness remaining in the strip after the controlling intervention are controlled. If the roll gap is re-set later, the regulation is interrupted and is controlled again as described above.

In controlling depending on the different roll gaps, the default counteracting bending force FB is applied on the back-up rolls 8, in order to obtain a bending of the working and back-up rolls. With the same goal, the counteracting bending force FB is also applied to the working rolls 2 to control non-planeness.

In regulation, an acquisition of the measured values for corresponding measuring materials takes place. Thereby, both the longitudinal profile and the cross section are measured. Directly following this, the recognition of the longitudinal profile and the cross section ensues, wherein the controlled deviation between the actual value and the theoretical value of each standard size is determined. Each correction value is then lead to a control loop. With the recognition of the longitudinal profile, the alteration $\Delta h$, corresponding to the default value, of the thickness of the metallic band is corrected to the default theoretical value. Concerning this, a corresponding alteration $\Delta S$ of the roll gap is necessary. The counteracting bending force FB needing to be applied to the working rolls 2 is, then again, ultimately dependent on the alteration of the roll gap S.

Figure 4:
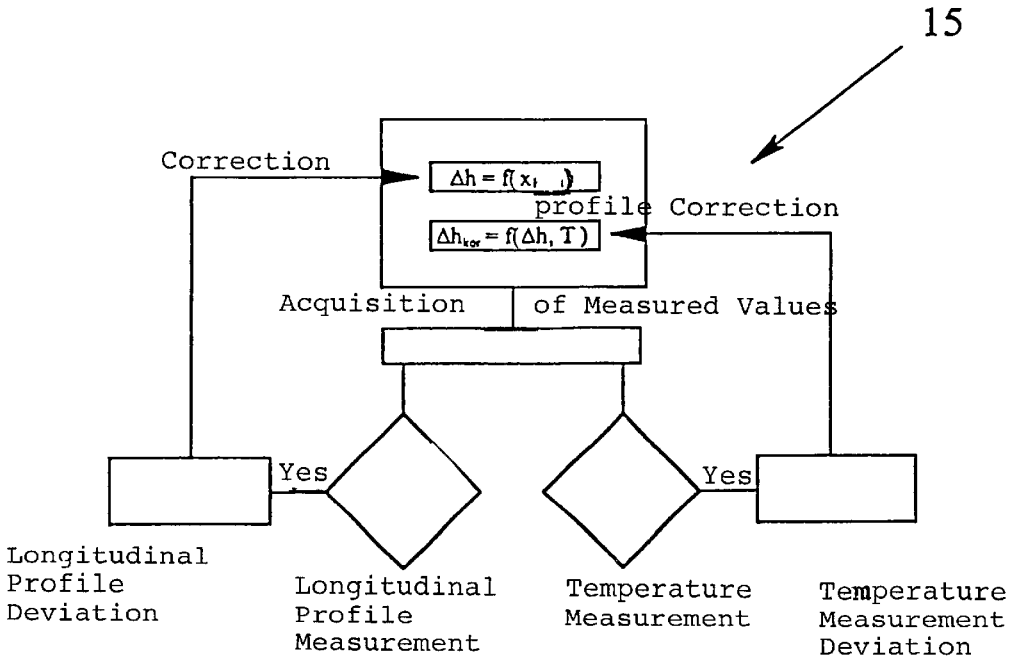
FIG. 4 is a representation of a further control loop.

The method described above does not yet take into consideration the temperature influence on the metallic strip in the rolling process. In this context, the control loop shown in FIG. 4 can be referred to. The inventive method for the flexible rolling of a metallic strip proceeds in such a manner that the roll gap and/or the rolling speed are deliberately influenced in order to compensate the temperature influence from rolling which has consequences on the thickness and length influence of the metallic strip. A profile identification is also first carried out here, wherein control deviations are determined. This length alteration and, at the same time, thickness alteration can be deliberately compensated by the alteration of the roll gap and/or the forward movement of the roll speed. As seen in the control loop in FIG. 4, the regulation of the roll gap results dependent on the measured length profile and the actual temperature of the rolled stock.

Furthermore, the method described above does not yet take into consideration the profile alteration of the metallic strip after flexible rolling. The inventive method for flexible rolling in consideration of the straightening influence proceeds in such a manner that the roll gap and/or the roll speed are deliberately influenced during the rolling process in order to already compensate during the rolling process the profile alterations occurring in the straightening. The roll gap and/or the forward-moving speed of the roll speed are changed via a pilot oscillator or a control loop in such a manner that, when compared to the straightened theoretical profile, a shorter and thicker profile of the metallic strip results, which corresponds to the default profile after straightening.

By the way, it is understood that the possibilities described for regulation, control and measuring from FIG. 1 to 3 are correspondingly usable in the compensation of the temperature influence and/or straightening influence.

In addition, it is indicated that the invention is not limited only to such methods in which metallic strips are flexibly rolled. The invention can also be used in the same manner for other rolled stock.

What is claimed is:

1. Method for the flexible rolling of a metallic strip, comprising the steps of, during a rolling procedure:

setting a roll gap which is formed between two working rolls, leading a metallic strip through the roll gap which is formed between the two working rolls, deliberately changing the roll gap to obtain different strip thicknesses over the length of the metallic strip, compensating for temperature influences on the metallic strip so as to prevent deviations from at least one of a theoretical thickness and a theoretical length of individual strip sections at a default end temperature of the metallic strip by adjusting the roll gap during rolling.

2. Method according to claim 1, said compensating step is carried out via at least one of a feedback control and a regulation.

3. Method according to of claim 2, wherein regulation is performed on the basis of at least one of the actual temperature of the metallic strip and a parameter from which the actual temperature is derivable.

4. Method according to of claim 2, wherein regulation is performed on the basis of a length alteration of a reference section of the metallic strip.

5. Method according to claim 1, wherein said compensating step comprises adjusting a roll speed during rolling.

6. Method according to claim 1, wherein the default end temperature of the metallic strip is an ambient temperature of approximately 20° C.

7. Method according to claim 1, wherein a deflection curve bending line of the working rolls is feedback controlled to obtain planeness of the metallic strip, depending on the roll gap, during or immediately after each changing of the roll gap.

8. Method according to claim 7, wherein the planeness is feedback controlled via at least one control loop after the setting of the roll gap.

9. Method according to claim 8, wherein shortly before or during changing of the roll gap, the feedback control for planeness is interrupted and the deflection curve bending line of the working rolls is controlled for the achievement of planeness for the new roll gap setting.

10. Method according to claim 7, wherein default counteracting bending forces are applied on at least one of the working rolls and on back-up rolls of the working rolls, dependent on the roll gap, in order to obtain a bending of at least the working rolls.

11. Method according to claim 8, wherein counteracting bending force is applied to at least one of the working rolls and backup rolls of the working rolls during the feedback control, which is adjusted to each load instance, to obtain a bending of at least the working rolls which corrects non-planeness of the metallic strip.

12. Method according to claim 8, wherein optical measurement of the planeness of the metallic strip is performed in a non-contact manner.

13. Method according to claim 12, wherein the planeness of the metallic strip is measured over the entire width of the metallic strip behind the roll gap for each increment of length.

14. Method according to claim 13, wherein thickness measuring laser stations are provided over the entire width of the metallic band and that the thickness measurement is performed via laser triangulation.

15. Method according to claim 8, wherein measurement of planeness is performed in a contact manner.

16. Method for the flexible rolling of a metallic strip, comprising the steps of, during a rolling procedure:

setting a roll gap which is formed between two working rolls, leading a metallic strip through the roll gap which is formed between the two working rolls, deliberately changing the roll gap to obtain different strip thicknesses over the length of the metallic strip, and compensating for a straightening influence on the metallic strip, which occurs in a straightening process after flexible rolling, during rolling to prevent deviations from at least one of a theoretical thickness and a theoretical length of individually straightened sections of the metallic strip.

17. Method according to claim 16, said compensating step is carried out via at least one of a feedback control and a regulation.

18. Method according to of claim 17, wherein regulation is performed on the basis of at least one of the actual temperature of the metallic strip and a parameter from which the actual temperature is derivable.

19. Method according to of claim 17, wherein regulation is performed on the basis of a length alteration of a reference section of the metallic strip.

20. Method according to claim 16, wherein said compensating step comprises adjusting of at least one of the roll gap and a roll speed during rolling.

21. Method according to claim 16, wherein the default end temperature of the metallic strip is an ambient temperature of approximately 20° C.

22. Method according to claim 16, wherein a deflection curve bending line of the working rolls is feedback controlled to obtain planeness of the metallic strip, depending on the roll gap, during or immediately after each changing of the roll gap.

23. Method according to claim 22, wherein the planeness is feedback controlled via at least one control loop after the setting of the roll gap.

24. Method according to claim 23, wherein shortly before or during changing of the roll gap, the feedback control for planeness is interrupted and the deflection curve bending line of the working rolls is controlled for the achievement of planeness for the new roll gap setting.

25. Method according to claim 22, wherein default counteracting bending forces are applied on at least one of the working rolls and on back-up rolls of the working rolls, dependent on the roll gap, in order to obtain a bending of at least the working rolls.

26. Method according to claim 23, wherein counteracting bending force is applied to at least one of the working rolls and backup rolls of the working rolls during the feedback control, which is adjusted to each load instance, to obtain a bending of at least the working rolls which corrects non-planeness of the metallic strip.

27. Method according to claim 23, wherein optical measurement of the planeness of the metallic strip is performed in a non-contact manner.

28. Method according to claim 27, wherein the planeness of the metallic strip is measured over the entire width of the metallic strip behind the roll gap for each increment of length.

29. Method according to claim 28, wherein thickness measuring laser stations are provided over the entire width of the metallic band and that the thickness measurement is performed via laser triangulation.

30. Method according to claim 23, wherein measurement of planeness is performed in a contact manner.

* * * * *

UNITED STATES PATENT AND TRADEMARK OFFICE

CERTIFICATE OF CORRECTION

PATENT NO. : 6,336,350 B1
DATED : January 8, 2002
INVENTOR(S) : Friedrich Klein and Andreas Hauger It is certified that error appears in the above-identified patent and that said Letters Patent is hereby corrected as shown below:

Title page,
Item [75], Inventor: insert:
-- [75] Inventor: Friedrich Klein, Attendorn (DE) and Andreas Hauger, Aachen (DE) --

Signed and Sealed this

Tenth Day of September, 2002

*Attest:*

*Attesting Officer*

JAMES E. ROGAN
*Director of the United States Patent and Trademark Office*